US006555513B2

(12) United States Patent
Singh

(10) Patent No.: US 6,555,513 B2
(45) Date of Patent: Apr. 29, 2003

(54) DETERGENT COMPOSITIONS

(75) Inventor: Amrat Paul Singh, Bebington (GB)

(73) Assignee: Unilever Home & Personal Care USA division of Conopco Inc., Greenwich, CT (US)

( * ) Notice: Subject to any disclaimer, the term of this patent is extended or adjusted under 35 U.S.C. 154(b) by 95 days.

(21) Appl. No.: 09/778,177

(22) Filed: Feb. 7, 2001

(65) Prior Publication Data

US 2001/0018409 A1 Aug. 30, 2001

(30) Foreign Application Priority Data

Feb. 7, 2000 (GB) ..... 0002749

(51) Int. Cl.[7] ..... C11D 1/04; C11D 1/14; C11D 1/28; C11D 1/62; C11D 1/65

(52) U.S. Cl. ..... 510/341; 510/350; 510/351; 510/356; 510/504; 510/302; 510/303; 510/320; 510/321

(58) Field of Search ..... 510/337, 338, 510/341, 350, 351, 356, 504, 302, 303, 320, 321

(56) References Cited

U.S. PATENT DOCUMENTS

| | | | | |
|---|---|---|---|---|
| 4,228,042 A | * | 10/1980 | Letton | 252/528 |
| 4,302,364 A | * | 11/1981 | Gosset et al. | 252/545 |
| 5,441,541 A | * | 8/1995 | Mehretaab et al. | 8/137 |
| 5,472,455 A | * | 12/1995 | Mehretaab et al. | 8/137 |
| 5,994,285 A | * | 11/1999 | Sachdev et al. | 510/329 |
| 6,127,379 A | * | 10/2000 | King et al. | 514/299 |
| 6,143,712 A | * | 11/2000 | Beckers et al. | 510/517 |
| 6,191,100 B1 | * | 2/2001 | Askew et al. | 510/504 |

FOREIGN PATENT DOCUMENTS

| | | |
|---|---|---|
| GB | 1 301 909 | 1/1973 |
| GB | 1 336 556 | 11/1973 |
| GB | 2 236 110 | 3/1991 |
| WO | 95/35361 | 12/1995 |
| WO | 96/05280 | 2/1996 |
| WO | 97/12018 | 4/1997 |
| WO | 97/43364 | 11/1997 |
| WO | 97/43365 | 11/1997 |
| WO | 97/43371 | 11/1997 |
| WO | 97/43387 | 11/1997 |
| WO | 97/43389 | 11/1997 |
| WO | 97/43390 | 11/1997 |
| WO | 97/43391 | 11/1997 |
| WO | 97/43393 | 11/1997 |
| WO | 97/49789 | 12/1997 |
| WO | 98/13453 | 4/1998 |

OTHER PUBLICATIONS

GB Search Report in a GB application GB 0002749.0.
Co–pending application: Grant et al.; Ser. No. 09/778,226; Filed: Feb. 7, 2001.
PCT International Search Report in a PCT application PCT 01/00571.
Derwent Abstract of WO 97/49789—published Jan. 2, 1998.
PCT International Search Report in a PCT application PCT 01/00573.

* cited by examiner

*Primary Examiner*—Gregory Delcotto
(74) *Attorney, Agent, or Firm*—Rimma Mitelman

(57) ABSTRACT

Laundry detergent compositions contain a sulphate or sulphonate anionic surfactant and a defined cationic surfactant in a weight ratio of 1:1 to 99:1. The cationic surfactant is a quaternary ammonium salt containing an ethoxylated alkyl chain. The compositions exhibit enhanced removal of oily soil.

13 Claims, No Drawings

DETERGENT COMPOSITIONS

TECHNICAL FIELD

The present invention relates to laundry detergent compositions containing a combination of anionic and cationic surfactants giving improved oily soil detergency.

BACKGROUND AND PRIOR ART

Laundry detergent compositions containing cationic (quaternary ammonium) surfactants in combination with anionic surfactants are disclosed in EP 2084A and EP 225A (Procter & Gamble) and a large number of later patent applications.

WO 97 43364, WO 97 43365A, WO 97 43371A, WO 97 43387A, WO 97 43389A, WO 97 43390A, WO 97 43391A and WO 97 43393A, (Procter & Gamble) disclose laundry detergent compositions containing so-called "AQA" alkoxylated quaternary ammonium surfactants in combination with other surfactants. The AQA surfactant has the general formula

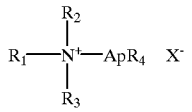

wherein $R_1$ is a $C_8$–$C_{18}$ alkyl group, $R_2$ is a $C_1$–$C_3$ alkyl group, and each of $R_3$ and $R_4$ is hydrogen, methyl or ethyl, A is $C_1$–$C_4$ alkoxy, and p is an integer from 2 to 30.

WO 97 12018A (Procter & Gamble) discloses liquid laundry detergents free of linear alkylbenzene sulphonate and containing a cationic surfactant that may optionally be ethoxylated, although no ethoxylated materials are exemplified or specifically disclosed.

GB 1 336 556 (Unilever) discloses a dishwashing detergent composition containing an amphoteric surfactant (Miranol H2M, an imidazole-based betaine), a $C_8$ alkane sulphonate, and an ethoxylated cationic surfactant of the formula

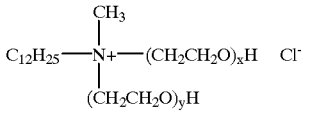

wherein the total of (x+y) is 12.

U.S. Pat. No. 5,994,285 (Colgate-Palmolive) discloses stable structured liquid detergent compositions containing alkylbenzene sulphonate, phosphate and carbonate builders, and an ethoxylated amine cationic surfactant of the formula

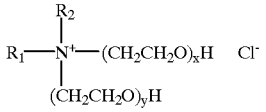

wherein $R_1$ is a $C_8$–$C_{18}$ hydrocarbon chain and $R_2$ is a $C_1$–$C_3$ alkyl group or a benzyl group, x and y are each 1 to 8 and (x+y) is from 2 to 9.

GB 1 301 909 (Atlas) discloses, as a surfactant mixture for use in surfactant/solvent textile treatment systems, a mixture of potassium lauryl sulphate and the ethyl chloride salt of polyoxypropylene(15)dodecylamine.

The present invention is based on the discovery that laundry detergent compositions containing certain cationic surfactants which are quaternary ammonium salts having an ethoxylated alkyl chain, in relatively small amounts in combination with larger amounts of anionic surfactants, give significantly enhanced removal of oily soils.

DEFINITION OF THE INVENTION

The present invention accordingly provides a laundry detergent composition comprising (a) an anionic sulphonate or sulphate surfactant and (b) a cationic surfactant of the general formula (I):

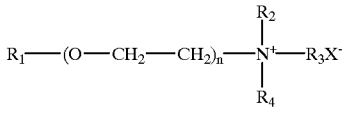

(I)

wherein $R_1$ is a $C_6$–$C_{20}$ alkyl group, n is an integer from 1 to 20, $R_2$ and $R_3$, which may be the same or different, each represents a $C_1$–$C_4$ alkyl group or a $C_2$–$C_4$ hydroxyalkyl group, $R_4$ represents a $C_1$–$C_4$ alkyl group, and $X^-$ represents a monovalent solubilising anion;

the weight ratio of (a) to (b) being from 1:1 to 99:1.

DETAILED DESCRIPTION OF THE INVENTION

The Ethoxylated Cationic Surfactant

In preferred ethoxylated cationic surfactants of the formula I used in accordance with the invention, $R_1$ is a $C_{10}$–$C_{16}$ alkyl group, n is from 1 to 4, $R_2$, $R_3$ and $R_4$ are methyl groups, and $X^-$ represents $Cl^-$.

An especially preferred ethoxylated cationic surfactant used in accordance with the present invention is of the formula I in which $R_1$ is a $C_{12}$–$C_{14}$ alkyl group, n is 3, $R_2$, $R_3$ and $R_4$ are methyl groups, and $X^-$ represents $Cl^-$.

This material has the formula II:

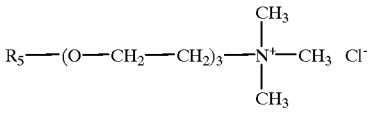

(II)

wherein $R_5$ is a $C_{12}$–$C_{14}$ alkyl group.

In the detergent compositions of the invention, the cationic surfactant is present in an amount of from 0.1 to 15 wt %, preferably from 0.2 to 10 wt %, more preferably from 0.5 to 5 wt %, suitably from 0.8 to 2 wt %.

Preparation of the Cationic Surfactant

The cationic surfactant may be prepared by a method analogous to that generally described by J Miller Harris in "Laboratory Synthesis of Polyethylene Glycol Derivatives"

JMS-Rev. Macromol. Chem. Phys. C25 (3), 325–345 (1985). According to this method, chlorides of PEG or similar materials may be prepared by reaction with thionyl chloride in toluene, and the chloride subsequently reacted with the relevant trialkylamine (eg trimethylamine) in ethanol to produce the corresponding quaternary ammonium chloride. Alternatively, PEG or similar materials may be reacted with phosphorus tribromide in diethyl ether/pyridine to form the corresponding bromide which can subsequently be reacted with a trialkylamine.

The Surfactant Combination

In the compositions of the invention, the weight ratio of anionic surfactant (a) to cationic surfactant (b) is from 1:1 to 99:1, preferably from 2:1 to 50:1, more preferably from 3:1 to 25:1. Especially good results are obtained when the ratio is within the range of from 4:1 to 20:1.

In preferred compositions of the invention, the amount of anionic surfactant may suitably range from 4 to 30 wt %.

In compositions containing no other surfactants, the amount of anionic surfactant may suitably range from 4 to 30 wt %, and the amount of the cationic surfactant may suitably range from 0.2 to 15 wt %.

Optionally a nonionic surfactant may also be present. In compositions containing a ternary surfactant system (anionic, nonionic and cationic) the preferred amounts are as follows:

(a) from 4 to 25 wt % of the anionic surfactant,
(b) from 0.2 to 10 wt % of the cationic surfactant,
(c) from 1 to 10 wt % of a nonionic surfactant.

Optionally soap may also be present, for example, in an amount of up to 5 wt %.

The Anionic Surfactant

The anionic surfactant is a sulphonate or sulphate anionic surfactant.

Anionic surfactants are well-known to those skilled in the art. Examples include alkylbenzene sulphonates, primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Preferably the anionic surfactant is linear alkylbenzene sulphonate or primary alcohol sulphate. More preferably the anionic surfactant is linear alkylbenzene sulphonate.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Many suitable detergent-active compounds are available and are fully described in the literature, for example, in "Surface-Active Agents and Detergents", Volumes I and II, by Schwartz, Perry and Berch.

Detergent Ingredients

As well as the surfactants discussed above, the compositions preferably contain detergency builders, and may optionally contain bleaching components and other active ingredients to enhance performance and properties.

The compositions may suitably contain from 10 to 80%, preferably from 15 to 70% by weight, of detergency builder. Preferably, the quantity of builder is in the range of from 15 to 50% by weight.

The detergent compositions may contain as builder a crystalline aluminosilicate, preferably an alkali metal aluminosilicate, more preferably a sodium aluminosilicate (zeolite).

The zeolite used as a builder may be the commercially available zeolite A (zeolite 4A) now widely used in laundry detergent powders. Alternatively, the zeolite may be maximum aluminium zeolite P (zeolite MAP) as described and claimed in EP 384 070B (Unilever), and commercially available as Doucil (Trade Mark) A24 from Crosfield Chemicals Ltd, UK. Zeolite MAP is defined as an alkali metal aluminosilicate of zeolite P type having a silicon to aluminium ratio not exceeding 1.33, preferably within the range of from 0.90 to 1.33, preferably within the range of from 0.90 to 1.20.

Especially preferred is zeolite MAP having a silicon to aluminium ratio not exceeding 1.07, more preferably about 1.00. The particle size of the zeolite is not critical. Zeolite A or zeolite MAP of any suitable particle size may be used.

Also preferred according to the present invention are phosphate builders, especially sodium tripolyphosphate. This may be used in combination with sodium orthophosphate, and/or sodium pyrophosphate.

Other inorganic builders that may be present additionally or alternatively include sodium carbonate, layered silicate, amorphous aluminosilicates.

Organic builders that may be present include polycarboxylate polymers such as polyacrylates and acrylic/maleic copolymers; polyaspartates; monomeric polycarboxylates such as citrates, gluconates, oxydisuccinates, glycerol mono-di- and trisuccinates, carboxymethyloxysuccinates, carboxymethyloxymalonates, dipicolinates, hydroxyethyliminodiacetates, alkyl- and alkenylmalonates and succinates; and sulphonated fatty acid salts.

Organic builders may be used in minor amounts as supplements to inorganic builders such as phosphates and zeolites. Especially preferred supplementary organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form. Detergent compositions according to the invention may also suitably contain a bleach system. The bleach system is preferably based on peroxy bleach compounds, for example, inorganic persalts or organic peroxyacids, capable of yielding hydrogen peroxide in aqueous solution. Suitable peroxy bleach compounds include organic peroxides such as urea peroxide, and inorganic persalts such as the alkali metal perborates, percarbonates, perphosphates, persilicates and persulphates. Preferred inorganic persalts are sodium perborate monohydrate and tetrahydrate, and sodium percarbonate. Especially preferred is sodium percarbonate having a protective coating against destabilisation by moisture. Sodium percarbonate having a protective coating comprising sodium metaborate and sodium silicate is disclosed in GB 2 123 044B (Kao).

The peroxy bleach compound is suitably present in an amount of from 5 to 35 wt %, preferably from 10 to 25 wt %.

The peroxy bleach compound may be used in conjunction with a bleach activator (bleach precursor) to improve bleaching action at low wash temperatures. The bleach precursor is suitably present in an amount of from 1 to 8 wt %, preferably from 2 to 5 wt %.

Preferred bleach precursors are peroxycarboxylic acid precursors, more especially peracetic acid precursors and peroxybenzoic acid precursors; and peroxycarbonic acid precursors. An especially preferred bleach precursor suitable for use in the present invention is N,N,N',N'-tetracetyl ethylenediamine (TAED). Also of interest are peroxybenzoic acid precursors, in particular, N,N,N-trimethylammonium toluoyloxy benzene sulphonate.

A bleach stabiliser (heavy metal sequestrant) may also be present. Suitable bleach stabilisers include ethylenediamine tetraacetate (EDTA) and the polyphosphonates such as Dequest (Trade Mark), EDTMP.

The detergent compositions may also contain one or more enzymes. Suitable enzymes include the proteases, amylases, cellulases, oxidases, peroxidases and lipases usable for incorporation in detergent compositions.

In particulate detergent compositions, detergency enzymes are commonly employed in granular form in amounts of from about 0.1 to about 3.0 wt %. However, any suitable physical form of enzyme may be used in any effective amount.

Antiredeposition agents, for example cellulose esters and ethers, for example sodium carboxymethyl cellulose, may also be present.

The compositions may also contain soil release polymers, for example sulphonated and unsulphonated PET/POET polymers, both end-capped and non-end-capped, and polyethylene glycol/polyvinyl alcohol graft copolymers such as Sokolan (Trade Mark) HP22. Especially preferred soil release polymers are the sulphonated non-end-capped polyesters described and claimed in WO 95 32997A (Rhodia Chimie).

Other ingredients that may be present include solvents, hydrotropes, fluorescers, photobleaches, foam boosters or foam controllers (antifoams) as appropriate, sodium carbonate, sodium bicarbonate, sodium silicate, sodium sulphate, calcium chloride, other inorganic salts, fabric conditioning compounds, and perfumes.

A typical detergent composition according to the invention may comprise:

(i) from 8 to 40 wt % of total non-soap surfactant,
(ii) from 10 to 80 wt % of detergency builder,
(iii) optionally from 0 to 5 wt % of soap,
(iv) optionally from 0 to 30 wt % of sodium carbonate,
(v) optionally from 0 to 30 wt % of bleaching ingredients,
(vi) optionally one or more detergency enzymes,
(vii) optionally other detergent ingredients to 100 wt %.

The other ingredients that may be present are preferably selected from fluorescers, photobleaches, antiredeposition agents, soil release agents, foam control agents, foam boosters, sodium sulphate, sodium silicate, sodium bicarbonate, perfumes and fabric conditioning agents.

Product Form and Preparation

As previously indicated, the compositions of the invention may be of any suitable physical form, for example, particulates (powders, granules, tablets), liquids, pastes, gels or bars.

According to one especially preferred embodiment of the invention, the detergent composition is in particulate form.

Powders of low to moderate bulk density may be prepared by spray-drying a slurry, and optionally postdosing (dry-mixing) further ingredients.

"Concentrated" or "compact" powders may be prepared by mixing and granulating processes, for example, using a high-speed mixer/granulator, or other non-tower processes.

According to another especially preferred embodiment of the invention, the detergent composition is in liquid form.

Liquid detergent compositions may be prepared by admixing the essential and optional ingredients in any desired order to provide compositions containing the ingredients in the the requisite concentrations.

EXAMPLES

The invention is illustrated in further detail by the following non-limiting Examples, in which parts and percentages are by weight unless otherwise stated.

Examples 1 to 4, Comparative Example A

Performance Appraisal of Anionic/Cationic Surfactant Mixtures on Kitchen Grease Soil Surfactant mixtures were prepared by mixing sodium linear alkylbenzene sulphonate (LAS) and a ethoxylated cationic surfactant of the formula II ($R_1$=$C_{12}$–$C_{14}$ alkyl, n has an average value of 3), in various proportions ranging from 95:5 (19:1) to 70:30 (2.33:1).

A detergent composition was prepared to the following formulation (parts by weight):

| Ingredient | |
|---|---|
| Total surfactant (LAS plus cationic) | 24.0 |
| Sodium tripolyphosphate | 2.4 |
| Sodium sulphate | 14.0 |
| Sodium carbonate | 15.0 |
| Sodium silicate | 7.0 |

Soil removal performance on knitted cotton and knitted polyviscose fabrics was measured in a tergotometer test. The soil used was soya bean oil (chosen as a typical greasy kitchen soil), coloured with a violet dye (0.08 wt %) to act as a visual indicator.

Test cloths (10 cm×10 cm), each soiled with 0.5 ml of violet-dyed soya bean oil, were washed in tergotometers using the detergent compositions above under the following conditions:

| | |
|---|---|
| Temperature | 25° C. |
| Liquor to cloth ratio | 30:1 |
| Product dosage | 2.0 g/l |
| Water hardness (° French) | 6 |
| Soak time | 10 min |
| Wash time (agitation) | 15 min |

The reflectance ΔE, indicative of total colour change (of the violet dye) across the whole visible spectrum, of each test cloth was measured before and after the wash. The results expressed as ΔΔΔE (the difference ΔΔE between reflectance values ΔE before and after the wash, compared with the 100% LAS control) are shown in the following table. These results are averaged over 8 replicates.

| | | | ΔΔΔE | |
|---|---|---|---|---|
| Example | LAS wt % | Cationic wt % | Knitted Cotton LSD = 1.30 | Knitted Polyviscose LSD = 1.25 |
| A | 100 | 0 | — | — |
| 1 | 95 | 5 | +4.0 | +3.6 |
| 2 | 90 | 10 | +4.0 | +4.0 |
| 3 | 80 | 20 | +3.8 | +2.5 |
| 4 | 70 | 30 | +0.4 | −3.0 |

Examples 5 to 8, Comparative Example B

Performance Appraisal of Anionic/Cationic Surfactant Mixtures on Mechanical Grease Soil Detergency on a different soil, mechanical grease (paraffinic oil with particulate iron and carbon dispersed therein), was assessed using the same fabrics and the same formulation and the same wash conditions as were used in Examples 1 to 4. No indicator dye was needed because the soil was itself sufficiently coloured by the presence of the particulate material.

The reflectance results (each averaged over 8 replicates) were as follows:

| | | | ΔΔΔE | |
|---|---|---|---|---|
| Example | LAS wt % | Cationic wt % | Knitted Cotton LSD = 3 | Knitted Polyviscose LSD = 2.1 |
| B | 100 | 0 | — | — |
| 5 | 95 | 5 | +0.4 | +1.1 |
| 6 | 90 | 10 | +0.9 | +2.7 |
| 7 | 80 | 20 | +0.4 | +1.5 |
| 8 | 70 | 30 | −1.0 | −0.1 |

Examples 9 to 20

Particulate Detergent Compositions

Examples 9 to 12

Low-Foaming Powder Formulations for Use in Drum-Type Automatic Washing Machines

| Ingredient | 9 | 10 | 11 | 12 |
|---|---|---|---|---|
| LAS | 5.8 | 5.4 | 8.8 | 7.8 |
| Nonionic 7EO | 3.4 | 3.4 | — | — |
| Cationic | 0.6 | 1.0 | 1.0 | 2.0 |
| STP[1] | | 25.0 | | |
| Na carbonate | | 6.3 | | |
| Na sulphate | | 23.0 | | |
| Na silicate | | 9.0 | | |
| Soil release polymer | | 0.7 | | |
| Na perborate | | 5.84 | | |
| TAED[2] | | 2.28 | | |
| Enzymes[3] | | 1.32 | | |
| Antifoam granules | | 2.0 | | |
| Water + minors | | to 100 | | |

[1]Sodium tripolyphosphate
[2]Tetracetylethylenediamine
[3]Protease, lipase, amylase Examples 13 to 16

Powder Formulations Suitable for Both Top-Loading and Drum-Type Washing Machines

| Ingredient | 13 | 14 | 15 | 16 |
|---|---|---|---|---|
| LAS | 10.5 | 10.0 | 9.5 | 9.0 |
| Nonionic 7EO | 5.0 | 5.0 | 5.0 | 5.0 |
| Cationic | 0.5 | 1.0 | 1.5 | 2.0 |
| STP | | 34.0 | | |
| Na carbonate | | 3.7 | | |
| Na silicate | | 7.0 | | |
| SCMC[1] | | 0.5 | | |
| Soil release polymer | | 0.35 | | |
| Na perborate | | 7.7 | | |
| TAED[2] | | 2.2 | | |
| Enzymes[3] | | 1.79 | | |
| Fluorescer | | 0.15 | | |
| Water + minors | | to 100 | | |

[1]Sodium carboxymethyl cellulose
[2]Tetracetylethylenediamine
[3]Protease, lipase, amylase, cellulase Examples 17 to 20

Powder Formulations Suitable for Both Top-Loading Machine Use and Handwash Use

| Ingredient | 25 | 26 | 27 | 28 |
|---|---|---|---|---|
| LAS | 23.0 | 22.0 | 21.0 | 20.0 |
| Cationic | 1.0 | 2.0 | 2.0 | 3.0 |
| STP | | 19.0 | | |
| Na carbonate | | 15.0 | | |
| Na sulphate | | 14.0 | | |
| Na silicate | | 7.0 | | |
| SCMC[1] | | 0.37 | | |
| Acrylate/maleate copolymer | | 1.5 | | |
| Na perborate | | 8.0 | | |
| TAED[2] | | 2.4 | | |
| Enzymes[3] | | 1.7 | | |
| Fluorescer | | 0.19 | | |
| Water + minors | | to 100 | | |

[1]Sodium carboxymethyl cellulose
[2]Tetracetylethylenediamine
[3]Protease, lipase, amylase

I claim:

1. A laundry detergent composition comprising (a) an anionic sulphonate or sulphate surfactant and (b) a cationic surfactant of the general formula (I):

(I)

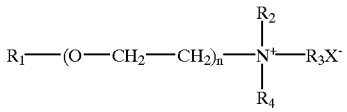

wherein $R_1$ is a $C_{12}$–$C_{14}$ alkyl group, n is from 2 to 4, $R_2$, $R_3$ and $R_4$ are methyl groups, and $X^-$ represents Cl;

the weight ratio of (a) to (b) being from 1:1 to 99:1.

2. A detergent composition as claimed in claim 1, wherein the weight ratio of (a) to (b) is from 2:1 to 50:1.

3. A detergent composition as claimed in claim 1, wherein the cationic surfactant is present in an amount of from 0.1 to 15 wt %.

4. A detergent composition as claimed in claim 1, wherein the anionic surfactant is present in an amount of from 4 to 30 wt %.

5. A detergent composition as claimed in claim 1, having a surfactant system consisting of (a) from 4 to 30 wt % of the anionic surfactant and (b) from 0.2 to 15 wt % of the cationic surfactant.

6. A detergent composition as claimed in claim 1, having a surfactant system consisting of (a) from 4 to 25 wt % of the anionic surfactant (b) from 0.2 to 10 wt % of the cationic surfactant (c) from 1 to 10 wt % of a nonionic surfactant, and (d) optionally from 0 to 5 wt % of soap.

7. A detergent composition as claimed in claim 1, wherein the anionic surfactant is linear alkylbenzene sulphonate.

8. A detergent composition as claimed in claim 1, which comprises (i) from 8 to 40 wt % of total non-soap surfactant, (ii) from 10 to 80 wt % of detergency builder, (iii) optionally from 0 to 5 wt % of soap, (iv) optionally from 0 to 30 wt % of sodium carbonate, (v) optionally from 0 to 30 wt % of bleaching ingredients, (vi) optionally one or more detergency enzymes, (vii) optionally other detergent ingredients to 100 wt %.

9. A detergent composition as claimed in claim 8, which further comprises one or more other detergent ingredients (vi) selected from the group consisting of fluorescers, photobleaches, antiredeposition agents, soil release agents, foam control agents, foam boosters, sodium sulphate, sodium silicate, sodium bicarbonate, perfumes and fabric conditioning agents.

10. A detergent composition as claimed in claim 1, wherein the weight ratio of (a) to (b) is from 3:1 to 25:1.

11. A detergent composition as claimed in claim 1, wherein the weight ratio of (a) to (b) is from 5:1 to 20:1.

12. A detergent composition as claimed in claim 1, wherein the cationic surfactant is present in an amount of from 0.2 to 10 wt %.

13. A detergent composition as claimed in claim 1, wherein the cationic surfactant is present in an amount of from 0.5 to 5 wt %.

* * * * *